US006578475B1

(12) United States Patent
Siedlaczek

(10) Patent No.: US 6,578,475 B1
(45) Date of Patent: Jun. 17, 2003

(54) METHOD AND DEVICE FOR LABELING OR PRINTING STACKABLE FLOWERPOTS

(76) Inventor: Udo Siedlaczek, An der Bleiche 45, Strahlen (DE), 47638

( * ) Notice: Subject to any disclaimer, the term of this patent is extended or adjusted under 35 U.S.C. 154(b) by 0 days.

(21) Appl. No.: 09/786,919

(22) PCT Filed: Mar. 17, 1999

(86) PCT No.: PCT/EP99/01759

§ 371 (c)(1),
(2), (4) Date: Mar. 12, 2001

(87) PCT Pub. No.: WO00/15502

PCT Pub. Date: Mar. 23, 2000

(30) Foreign Application Priority Data

Sep. 11, 1998 (DE) ..... 198 41 907
Nov. 19, 1998 (DE) ..... 298 20 673 U

(51) Int. Cl.[7] ..... B41F 17/00
(52) U.S. Cl. ..... 101/35; 101/33; 101/4
(58) Field of Search ..... 101/35, 33, 4, 101/53, 131; 156/362, 363, 542, 556; 53/244, 246, 247, 534, 539

(56) References Cited

U.S. PATENT DOCUMENTS 3,905,292 A * 9/1975 Rossi ..... 101/40
4,052,250 A 10/1977 Potts
4,148,683 A 4/1979 Potts
5,024,048 A 6/1991 Moore
5,120,392 A * 6/1992 Butkevich et al. ..... 156/566
5,388,683 A * 2/1995 Norton ..... 198/379

* cited by examiner

*Primary Examiner*—Andrew H. Hirshfeld
*Assistant Examiner*—Darius N. Cone
(74) *Attorney, Agent, or Firm*—Nixon Peabody LLP; David S. Safran

(57) ABSTRACT

A method and device for labeling or printing stackable flowerpots (2), wherein the flowerpots (2) are fed to a magazine feed device (3) so that a stack (4*a*) of flowerpots (2) to be labeled or printed is formed in the magazine feed device (3), wherein the stack (4*a*) of flowerpots to be labeled or printed is at least partially separated into individual flowerpots (2) and the flowerpot (2) located in the at least partially unstacked position is labeled or printed, after which, the labeled or printed flowerpot (2) is fed to a stack (4*b*) of labeled or printed flowerpots (2). The direction of conveyance (F) and the direction (S) of the stack of the flowerpots (2) are substantially identical immediately before and after labeling or printing and wherein the stack (4*b*) of labeled or printed flowerpots (2) are moved out in a substantially continuous manner by means of an evacuation device (8), thereby enabling a simple, fast method for rapidly labeling or printing flowerpots (2).

21 Claims, 2 Drawing Sheets

METHOD AND DEVICE FOR LABELING OR PRINTING STACKABLE FLOWERPOTS

BACKGROUND OF THE INVENTION

1. Field of the Invention

Figure 1:
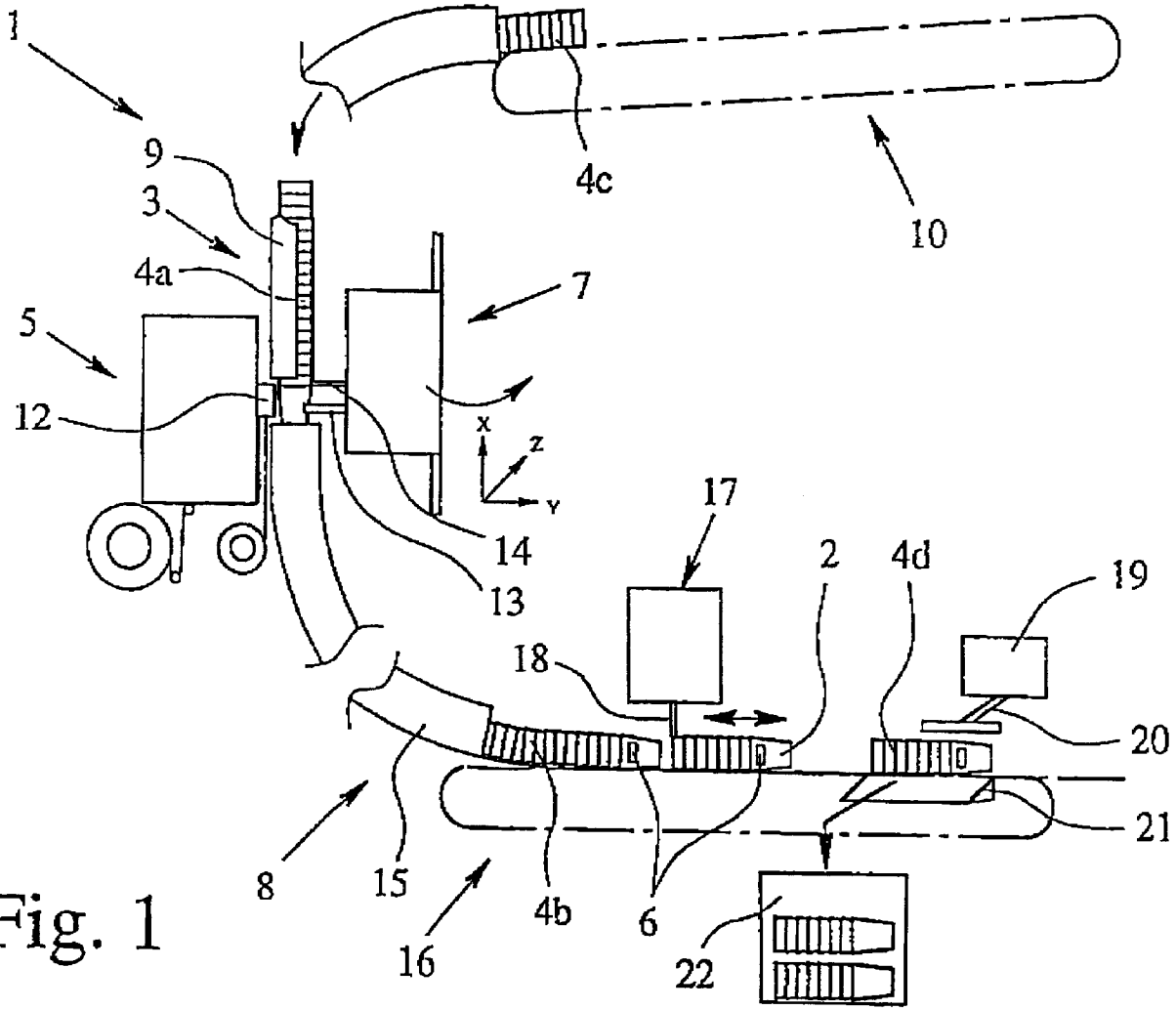

The invention relates to a process and device for labeling or printing of stackable flower pots.

2. Description of Related Art

A process and device for labeling of flower pots are known from practice, the flower pots being supplied individually to a labeling means. After labeling, the individual flower pots are stacked, packed into cartons, and shipped. This known process has the defect that the labeling speed is comparatively low. Furthermore, a process for printing of flower pots is known from practice; it is carried out in the same way as the labeling process, only that printing is performed instead of labeling. The printing speed is also comparatively slow in this process.

SUMMARY OF THE INVENTION

The object of the invention is therefore to provide a process and device for labeling or printing of stackable flower pots with which the labeling or printing can be performed quickly and easily.

The aforementioned object is achieved in accordance with the invention essentially by the process in which containers are continuously removed from a stack and are printed or labeled as they are removed without reversal of their direction of movement. The object is achieved by the device of the invention in that the containers are fed by a first generally horizontal conveyor into a stack within roughly vertical orientated magazine located next to the printing or labeling mechanism, and from which containers are separated briefly for printing or labeling and then re-stacked for transfer to receiving area. The advantage of the invention lies in the result that a more or less continuous stack of flower pots to be labeled or printed is supplied, the stack is interrupted briefly only for labeling or printing and is re-assembled after labeling or printing. The essentially identical alignment of the conveying direction and the stacking direction directly before and after labeling or printing means that the directions are essentially coaxial or essentially parallel to one another. The high labeling or printing speed with the process and the device in accordance with the invention, therefore, ultimately arises due to the prompt unstacking of a continuous stack for labeling or printing. It was ascertained in tests that with the invention that a labeling speed of up to ten applied labels per second can be achieved.

Incidentally, it should be pointed out that the invention is used preferably for flower pots. In any case, the invention can be carried out with the aforementioned principle of the brief unstacking of a continuous stack as claimed in the invention also for other types of stackable containers, for example, cream or yoghurt cups. The following details therefore also apply to all stackable containers accordingly.

Preferably, it is furthermore provided that the magazine has an elongated guide for the stack of flower pots to be labeled or printed and that the magazine has a feed conveyor belt for transfer of the flower pots to the guide. Basically, it is also possible to label or print the flower pots in a horizontal or oblique state of the flower pots. The essentially vertical arrangement of the flower pots in labeling or printing is especially advantageous since, in this case, after labeling or printing, the force of gravity can be used to supply the just labeled or printed flower pots to the stack of already labeled or printed flower pots. The just labeled or printed flower pot then drops essentially by itself into the stack of labeled or printed flower pots and is automatically stacked up again. Structurally, this is achieved by a guide in the area of the labeling or printing means having a roughly vertical alignment.

With respect to the high labeling or printing speed which is ensured by the process and the device as in accordance with the invention, it is a good idea for the flower pots to be supplied to the magazine in stack form. To do this, there are two basic possibilities, specifically, on the one hand, the flower pots are supplied such that the stacking direction and the conveyor direction are the same during supply via a feed conveyor belt. Ultimately, then, the magazine is supplied with a single, more or less endless stack which is refilled again and again manually or mechanically. The other possibility is that the conveyor direction, during supply via the feed conveyor belt, is offset by 90 degrees relative to the stack direction. In doing so, then individual stacks are always introduced into the magazine. Structurally, to implement the aforementioned alternative of feeding the stack of flower pots such that the stacking direction and the conveyor direction are the same, it is provided that the guide is tilted on its end facing the feed conveyor belt in the direction toward the feed conveyor belt. In the other alternative embodiment, on the feed conveyor belt there are receivers for positioning of the vertical stack of flower pots which are to be labeled or printed. The individual, smaller supplied stacks are then tipped by the feed conveyor belt into the stack which is located in the guide of the magazine.

Since flower pots and other stackable containers can have different sizes, it is especially advantageous if the unstacking means and the labeling or printing means can be adjusted in the x, y and/or z direction relative to one another. In this way, the device as in accordance with the invention can be matched to any conditions.

The at least partial unstacking of the flower pots for labeling or printing can take place via different structural means. In one alternative, the unstacking means has two arms which fit periodically into the stack. While one of these arms, on the one hand, is used for holding one flower pot to be labeled or printed, and on the other hand, for subsequent removal of the flower pot from the stack after labeling or printing, the other arm is used solely for holding the stack in the magazine over the flower pot to be labeled or printed. In another alternative version, there is a worm with a spiral pitch which becomes smaller in the direction away from the labeling or printing means and which becomes larger in the direction toward the labeling or printing means. This embodiment offers the additional advantage that, on the side opposite the labeling or printing means, before, during and after labeling or printing there is always guidance for the flower pots. Finally, the unstacking means also on opposite sides can have rotating means which are driven preferably roughly at a right angle to the labeling or printing direction and which cause at least partial unstacking of the flower pots in the area of the labeling or printing means. Otherwise, of course, there are also other basic possibilities for unstacking.

The flower pots can be printed in any known manner of printing. Preferably, ink is sprayed on the flower pot. The printing means therefore has no direct contact with the flower pot. Labeling can be done in different ways. On the one hand, it is fundamentally possible to roll on the labels. But preferably, the labels are applied pneumatically, i.e., blown onto the respective flower pot. This also enables a high labeling speed of the device and the process. Since it can happen that the labels do not adhere completely to the respective flower pots, to ensure a smooth process, it is provided that the labels are pressed on after application in an additional pressing step before the just labeled flower pot is supplied to the stack of already labeled flower pots. Structurally, this is done by there being a pressing means for pressing the label which has been applied to the flower pot directly adjacent to the labeling means, and in one simple embodiment, the pressing means have brush filaments or another elastic material.

Especially in conjunction with the aforementioned pressing means, but essentially also when there are none of these pressing means, it is a good idea when, immediately after labeling or printing, a pressure blast directed into the flower pot is produced in order to accelerate the re-stacking or downward motion of the just labeled or printed flower pot. Structurally, for this purpose, there is a pneumatic pressure blast means for producing the pressure blasts which are directed in the flower pot immediately after labeling or printing.

To ensure the continuous removal of the labeled or printed flower pots, it is provided during removal that the stack of labeled or printed flower pots is supplied to a discharge conveyor belt of the removal means, the conveyor and stacking direction of the stacked flower pots on the discharge conveyor belt being the same. Structurally, in the discharge conveyor means, there is a guide following the unstacking means and the aforementioned discharge conveyor belt which follows the guide in order to supply the stack of labeling or printed flower pots to the discharge conveyor belt.

Since the labeled or printed flower pots are generally sold packed in cartons in smaller stacks, within the framework of the process in accordance with the invention, it is additionally provided that the continuous stack of labeled or printed flower pots on the discharge conveyor belt are separated into smaller stacks with a stipulated number of the labeled or printed flower pots, the smaller stacks being tipped off the discharge conveyor belt and preferably roll into a ready carton. Structurally, for this purpose, there is a separation means, especially in the area of the belt end of the discharge conveyor belt, for producing smaller stacks with a predetermined number of flower pots, and following the separation device, there can be a tipping means. This can have a slider which can be moved transversely to the conveyor direction and which tips the individual small stacks over a corresponding ramp.

The entire labeling or printing process according to the invention is preferably controlled by a corresponding control means. The speeds of the feed conveyor belt, the discharge conveyor belt, unstacking, labeling or printing and/or separation and/or tipping are adjustable and are matched to one another especially such that the labeling or printing process is continuous.

The process and the device in accordance with the invention are especially suited when small labels or print areas are to be applied to the flower pots. In this case, brief unstacking is enough for labeling or printing. After the labeling or printing process, the respective flower pot is stacked again, the conveyor direction and the stacking direction being coaxial immediately before and immediately after labeling or printing. When larger labels or print areas are to be applied to the flower pot, it is a good idea to remove the respective flower pot entirely from the respective stack. In this case, the flower pot is then supplied to a conveyor means which moves roughly transversely to the stacking direction. On the conveyor means which can be, for example, a turntable or an elongated guide in the form of a conveyor belt, the flower pot is then freely accessible so that the label or printing can be applied. For very long labels or print areas, the flower pot can be turned around its middle axis in the area of the conveyor means up to 360°. Rotation of the respective flower pot can be accomplished via two guide rails which move relative to one another and which are located on opposite sides and which are in contact with the flower pot. The relative motion of the guide rails and the flower pot which is located in between causes rotation of the flower pot. In doing so, one of the guide rails can even be made as a label dispenser or printing head so that, during rotation of the flower pot, the label or the printing can be applied. After labeling or printing, the respective flower pot is again supplied to the stack of already labeled or printed flower pots so that, ultimately, a continuous stack of flower pots is removed.

Other features derive from the following description of embodiments using the drawings and the drawings themselves.

BRIEF DESCRIPTION DRAWINGS

Figure 2:
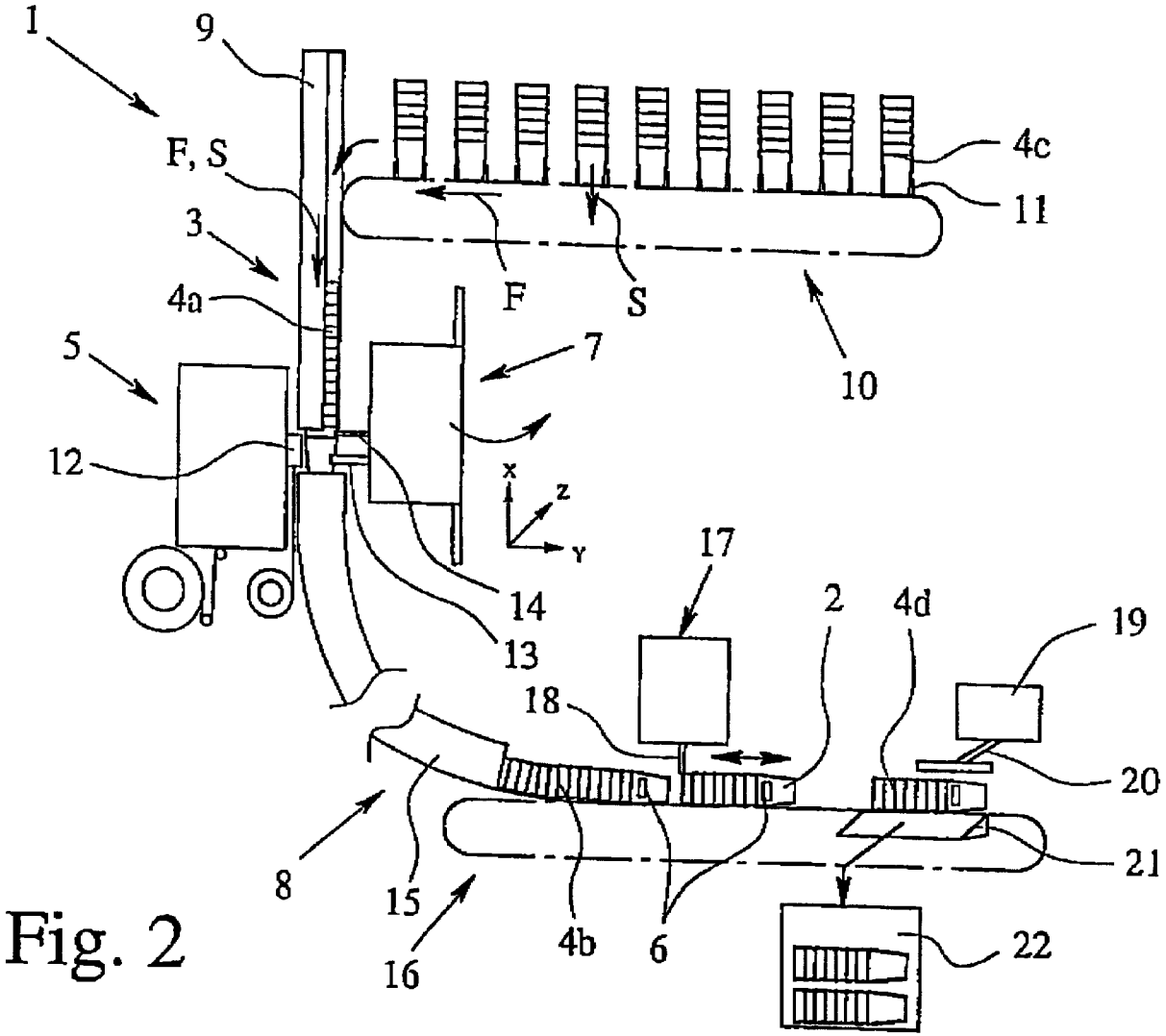

FIG. 1 shows a schematic of a device in accordance with the invention from which the process according to the invention is apparent; and FIG. 2 shows a view corresponding to that of FIG. 1, but showing another embodiment of a device in accordance with the invention.

DETAILED DESCRIPTION OF THE INVENTION

The figures schematically show a device 1 for labeling of flower pots 2. The device 1 has a magazine 3 for magazining and guidance of a stack 4*a* of flower pots 2 which are to be labeled and which, preferably, are made of plastic, a labeling mechanism 5 for applying labels 6, an unstacking means 7 for at least partial unstacking of the flower pots 2 for labeling, and a removal means 8 for especially continuous removal of the stacked, labeled flower pots 2. It is not shown that the device according to the invention can also be used for printing of flower pots. In this case then, instead of the labeling mechanism 5, a printing mechanism is provided there. The following details thus apply accordingly to a device I which works with a printing mechanism as well.

As follows from the two figures, the magazine 3 has an elongated guide 9 for the stack 4*a* of flower pots 2 to be labeled. The guide 9 can be made tubular or angled when viewed in cross section. Furthermore a feed conveyor belt 10 is provided for transferring of the flower pots 2 which are located on the feed conveyor belt 10 into the guide 9 of the magazine 3.

While, in the two embodiments, the guide 9 has a roughly vertical alignment in the area of the labeling means, in the embodiment shown in FIG. 1, it is provided that the guide 9, on its end facing the feed conveyor belt 10, is tilted or bent in the direction toward the feed conveyor belt 10. Otherwise, as follows from FIG. 1, the feed conveyor belt 10 is inclined descending at a flat angle toward the guide 9. Smaller stacks 4*c* are placed horizontally on the feed conveyor belt 10 and are then transferred via the belt to the guide 9 where they refill the stack. Conversely, as in the embodiment of FIG. 2, receivers 11 can be provided on the feed conveyor belt 10 for the arrangement of vertical stacks 4*c* of flower pots 2. In such a case, the guide 9 extends over its entire length in the vertical direction and projects beyond the feed conveyor belt 10. Here, the individual stacks 4*c* are tipped on the end of the belt into the guide 9 and are likewise added to stacks within the magazine.

The labeling mechanism 5 is located with its labeling area 12 underneath the guide 9. The labeling mechanism 5 works pneumatically—the respective labels 6 are therefore blown onto the flower pots 2. This can take place with very high speeds, i.e., at a rate of up to eight labels per second.

Opposite the labeling mechanism 5 is the unstacking means 7. The unstacking means 7 and the labeling mechanism 5 can be moved in all directions relative to one another. This adjustability makes it possible to set the distance between the flower pot 2 to be labeled and the labeling area 12 of the labeling means 5 to a few millimeters in order hereby to ensure prompt and simple application of the labels. In this embodiment, the unstacking means 7 is otherwise pivotally mounted so that the unstacking means 7 can be swivelled away from the labeling means 5 in order to ensure prompt and simple accessibility to the labeling area 12; this is necessary for any disruptions. In doing so, the guide 9 can be connected to the unstacking means 7 in order to ensure better accessibility to the labeling means 5. This however need not necessarily be the case.

In the embodiment shown, the unstacking means 7 has a first arm 13 and a second arm 14. The first arm 13 holds the flower pot 2 to be labeled. After labeling, the first arm 13 moves somewhat down and pulls the flower pot 2 which has just been labeled out of the stack 4*a*. The second arm 14 which is located on top of it during this process holds the stack 4*a* securely. To do this, there can be a horizontally U-shaped receiver on the second arm 14 which grips the projecting edge on the next-to-last or last flower pot 2 of the stack 4*a*. Then, the second arm 14 is moved somewhat down. Then, the first arm 13 again grabs while the second arm 14 in turn grips the next to last flower pot 2 of the stack 4*a*. Other embodiments of the unstacking means 7 are possible. This was already explained above.

To the bottom, following the labeling means 5 or the unstacking means 7 is a guide 15 of the removal means 8. The guide 15 can be made similarly to the guide 9. It is important that the lower end of the guide 9 is aligned with the top end of the guide 15, the guides 9, 15 therefore pass directly into one another and are interrupted only at a point at which the pertinent engagement means of the unstacking means 7, on the one hand, and the labeling area 12 of the labeling means 5, on the other, are located.

Next to the guide 15, the removal means 8 has a discharge conveyor belt 16. The guide 15 is therefore used to feed the stack 4b of labeled flower pots 2 to the discharge conveyor belt 16.

It is not shown that, following the labeling mechanism 5, there are pressing means for pressing the label 6 which is applied to the flower pot 2. These pressing means can, for example, be provided as brush filaments directly below the labeling area 12 or at the start of the guide 15. Furthermore, it is not shown that there can be a pneumatic pressure blast means which produces pressure blasts directed into the flower pot 2 which has just been labeled to accelerate the downward motion of the flower pots 2 which have just been labeled.

Furthermore, there is a separation means 17 which, in the embodiment shown, has an arm 18 which can be moved back and forth. The arm 18 fits into the flower pots 2 which have been labeled on continuous stacks 4*b*, and in doing so, separates a smaller stack 4*d* with a predetermined number of labeled or printed flower pots 2.

Following the separation means 17, there is an ejection means 19. The ejection means 19, likewise, has an arm 20 which can be moved forward and back in order to push down the individual smaller stacks 4*d* from the discharge conveyor belt 16. The small stacks 4*d* then roll over a ramp 21 into a carton 22 placed there.

The process according to the invention for labeling flower pots 2, at this point, runs as follows. An operator pushes flower pots 2 stacked either in the stack 4*a* which lies on the feed conveyor belt 10 or places them as separate small stacks 4*c* on the feed conveyor belt 10 so that a more or less continuous stack 4*a* of flower pots 2 is formed in the guide 9 of the magazine 3, or the individual smaller stacks 4*c* are manually set into the respective receivers 11 of the feed conveyor belt 10 and from there are ejected into the guide 9 of the magazine. As a result of gravity, the stack 4*a* is pressed down. In doing so, the two arms 13, 14 prevent the stack 4 of flower pots 2 which have not yet been labeled from slipping through. The function of the two arms 13, 14 was explained above. After at least partial unstacking of the stack 4*a* for labeling, the just labeled flower pot 2 is withdrawn from the stack 4*a* via the arm 13. This flower pot then falls into the guide 15 optionally supported by a pressure blast and is stacked up there again into the stack 4*b* of labeled flower pots 2. Via the guide 15 which need not extend as far as the belt 16, the stack 4*b* is placed on the discharge conveyor belt 16, and then via the separation means 17, is separated again into small stacks 4*d* which fit into the carton 22. The individual smaller stacks 4*d* are finally ejected via the ejection means 19 from the discharge conveyor belt 16 into the carton 22.

What is claimed is:

1. Process for labeling or printing of stackable containers comprising the steps of:

supplying containers along a longitudinal conveying axis to a magazine so as to be placed in an unlabeled or unprinted stack of containers within the magazine;

moving the stack of unlabeled or unprinted containers within the magazine along the longitudinal conveying axis to a labeling or printing area;

at the labeling or printing area at least partially unstacking an individual container from the stack for labeling or printing of the individual container;

labeling or printing the at least partially unstacked, individual container at a site adjacent the magazine;

after labeling or printing, supplying along the longitudinal conveying axis the at least partially unstacked, individual container to re-stack the labeled container in a stack of labeled or printed containers;

wherein the movement of the stack of unlabeled containers along the longitudinal conveying axis is momentarily halted in the labeling or printing area to permit labeling or printing of the container without a change in longitudinal direction of movement of the container, wherein before and after labeling or printing the direction of movement along the longitudinal conveying axis of the unlabeled or unprinted stack in the labeling or printing area is essentially identical to the direction of movement of the stack of labeled or printed containers such that during movement in the labeling or printing area there is only movement of the container in the labeling or printing area in a forward direction with respect to the longitudinal conveying axis of the stack of unlabeled or unprinted containers, and wherein the labeling or printing of the containers is carried out substantially continuously.

2. Process as claimed in claim 1, wherein the containers are supplied to the magazine in the form of stacks of containers; and wherein a conveyor belt supplies the stacks of containers to the longitudinal conveying axis of the containers in the magazine in a direction offset by approximately 90 degrees from longitudinal conveying axis.

3. Process as claimed as claimed in 1, wherein the at least partially unstacked, individual containers to be labeled or printed are vertically oriented during labeling or printing and after labeling or printing, fall into the stack labeled or printed containers at least under their own weight.

4. Process as claimed in claim 3, wherein an air blast is produced in order to accelerate falling of the at least partially unstacked, individual containers into the stack of just labeled or printed containers.

5. Process as claimed in claim 1, wherein after the at least partially unstacked, individual container is labeled the label is pressed on the container before the container is supplied to the stack of labeled containers.

6. Process as claimed in claim 1, wherein the stack of labeled or printed containers is supplied to a discharge conveyor belt of a removal arrangement.

7. Process as claimed in claim 6, wherein a conveying direction and a stacking direction of the stacked containers are the same upon removal on the discharge conveyor belt, and wherein the stack of labeled or printed containers on the discharge conveyor belt is separated into smaller stacks with a predetermined number of labeled or printed containers; and wherein the smaller stacks are tipped off the discharge conveyor belt.

8. Process as claimed in claim 1, wherein the containers are supplied, stacked, at least partially unstacked, labeled or printed and supplied after labeling or printing at speeds that are matched to one another such that the labeling or printing process is substantially continuous.

9. Process as claimed in claim 1, wherein the containers are flower pots.

10. Device for labeling or printing of containers, comprising:

a supplying means for supplying containers along a longitudinal conveying axis to a magazine;

a magazine for receiving containers from the supplying means so as to form a stack of unlabeled or unprinted containers within the magazine and for guiding the stack of unlabeled or unprinted containers along the longitudinal conveying axis;

an unstacking means adjacent the magazine for at least partially unstacking of an individual container from said stack of unlabeled or unprinted containers in the magazine;

a labeling or printing means for applying labels or printing to an individual, at least partially unstacked container, said labeling or printing means being positioned adjacent said magazine;

means for re-stacking of the individual container after labeling or printing into a stack of labeled or printed containers; and removal means positioned along the longitudinal conveying axis for removal of the re-stacked labeled or printed containers, wherein before and after labeling or printing the direction of movement along the longitudinal conveying axis of the unlabeled or unprinted stack in the vicinity of the labeling or printing means is essentially identical to the direction of movement of the stack of labeled or printed containers such that during movement through the labeling or printing means there is only movement of a container through the labeling or printing area in a forward direction with respect to the longitudinal conveying axis of the stack of unlabeled or unprinted containers.

11. Device as claimed in claim 10, wherein the magazine has an elongated guide for the stack of containers to be labeled or printed which is positioned vertically in the area of the labeling or printing means.

12. Device as claimed in claim 11, further comprising a feed conveyor belt for transferring containers to the guide; and wherein the guide on an end facing the feed conveyor belt is tilted in a direction toward the feed conveyor belt.

13. Device as claimed in claim 11, further comprising a feed conveyor belt for transferring containers to the guide; and wherein there are receivers on the feed conveyor belt for arrangement of vertical stacks of the containers to be labeled to printed.

14. Device as claimed in claim 10, wherein the unstacking means is located opposite the labeling and printing means.

15. Device as claimed in claim 10, wherein the labeling or printing means and the unstacking means are adjustable relative to one another in x, y and z directions.

16. Device as claimed in claim 10, further comprising a pneumatic pressure blast means for producing pressure blasts which are directed into the container immediately after labeling or printing.

17. Device as claimed in claim 10, wherein the labeling or printing means is a labeling means; and wherein a pressing means for pressing a label which has been applied to the container is provided directly adjacent to the labeling means.

18. Device as claimed in claim 10, wherein the containers are flower pots; and wherein the unstacking means has at least two arms which periodically fit into the stack of unlabeled or unprinted flower pots, and which are adapted to hold the unlabeled or unprinted stack for labeling or printing and to remove a flower pot that has been labeled or printed from the unlabeled or unprinted stack.

19. Device as claimed in claim 10, wherein the removal means has a guide following the unstacking means and a discharge conveyor belt which follows the guide for receiving the re-stacked labeled or printed containers from the guide.

20. Device as claimed in claim 10, further comprising a separation means for separating the re-stacked labeled or printed containers into smaller stacks with predetermined numbers of containers.

21. Device as claimed in claim 20, wherein the removal means comprises a discharge conveyor belt and a guide between the unstacking means and discharge conveyor belt for feeding the re-stacked labeled or printed containers to the discharge conveyor belt; and wherein a tipping means is provided following the separation means for removal of the smaller stacks from the discharge conveyor belt.

* * * * *